US012409358B2

(12) United States Patent
Shen

(10) Patent No.: US 12,409,358 B2
(45) Date of Patent: Sep. 9, 2025

(54) DUMBBELL ASSEMBLY

(71) Applicant: XIAMEN EDDE SPORTS TECHNOLOGY CO., LTD., Xiamen (CN)

(72) Inventor: Lingpeng Shen, Xiamen (CN)

(73) Assignee: XIAMEN EDDE SPORTS TECHNOLOGY CO., LTD., Xiamen (CN)

( * ) Notice: Subject to any disclaimer, the term of this patent is extended or adjusted under 35 U.S.C. 154(b) by 88 days.

(21) Appl. No.: 18/418,230

(22) Filed: Jan. 20, 2024

(65) Prior Publication Data

US 2025/0235733 A1 Jul. 24, 2025

(51) Int. Cl.
*A63B 21/072* (2006.01)
*A63B 21/075* (2006.01)

(52) U.S. Cl.
CPC ..... *A63B 21/0726* (2013.01); *A63B 21/0728* (2013.01); *A63B 21/075* (2013.01)

(58) Field of Classification Search
CPC ..... A63B 21/0724; A63B 21/0726; A63B 21/0728; A63B 21/0722; A63B 21/072; A63B 21/075; A63B 21/0622; A63B 21/0624; A63B 21/063
See application file for complete search history.

(56) References Cited

U.S. PATENT DOCUMENTS

2009/0305852 A1* 12/2009 Hoglund ..... A63B 21/075 482/107
2018/0008878 A1* 1/2018 Myre ..... A63B 21/0726
2019/0366142 A1* 12/2019 Dale ..... A63B 21/0724
2023/0173328 A1* 6/2023 Wu ..... A63B 21/075 482/107
2023/0321474 A1* 10/2023 Nalley ..... A63B 21/4035 482/107
2025/0025738 A1* 1/2025 Li ..... A63B 21/0726

* cited by examiner

*Primary Examiner* — Megan Anderson
*Assistant Examiner* — Jonathan A Dicuia

(57) ABSTRACT

A dumbbell assembly includes a dumbbell, and the dumbbell includes a dumbbell rod, dumbbell pieces and fixing plates; the dumbbell rod includes a grip rod and two telescopic rods connected to the grip rod. The dumbbell piece includes a first surface and a second surface which are opposite to each other, a mounting hole is formed in each dumbbell piece, a first guide portion which is obliquely arranged on the first surface, a second guide portion which is obliquely arranged on the second surface, the first guide portion is matched with the second guide portion, and the first guide portion and the second guide portion are located at the two opposite ends of the dumbbell piece respectively in the first direction. The installation difficulty of the action of installing the dumbbell rod into the dumbbell base is reduced.

6 Claims, 6 Drawing Sheets

DUMBBELL ASSEMBLY

TECHNICAL FIELD

The present disclosure relates to the technical field of training equipment, in particular to a dumbbell assembly.

BACKGROUND

Dumbbells are simple equipment used to enhance muscle strength training, including fixed weight dumbbells and adjustable weight dumbbells.

Traditional adjustable weight dumbbells are mainly composed of dumbbell rods and dumbbell pieces, and dumbbell bases for storage. The dumbbell pieces to be assembled are stacked and stored on the dumbbell base. When adjusting the weight, the dumbbell rod and the dumbbell pieces assembled on the dumbbell rod must be loaded into the dumbbell base, and then the number of dumbbell pieces assembled on the dumbbell rod needs to be adjusted. Due to the limitation of the structure of the dumbbell piece, when the dumbbell rod is installed into the dumbbell base, the installation angle is relatively high, so that the installation of the dumbbell rod becomes difficult, resulting in troublesome adjustment of the counterweight of the dumbbell.

SUMMARY

The purpose of the present disclosure is to provide a dumbbell assembly without the technical problems including the installation of the dumbbell rod into the dumbbell base and adjusting the counterweight.

In order to solve the above problems, the disclosure provides a dumbbell assembly, which includes a dumbbell and a dumbbell base for placing the dumbbell, and the dumbbell includes:

- a dumbbell rod, including a grip rod and two telescopic rods connected to the grip rod, the grip rod and the telescopic rod are coaxially arranged, and the rotation of the grip rod can drive the two telescopic rods to move away or towards each other along an axial direction of the grip rod;
- dumbbell pieces, each dumbbell piece includes a first surface and a second surface opposite to each other, and the dumbbell piece is provided with a mounting hole passing through the first surface and the second surface and allowing the telescopic rod to pass through, there is a first guide portion on the first surface, the first guide portion is inclined and extends from the edge of the first surface toward the middle of the first surface, and there is a second guide portion on the second surface, the second guide portion is arranged obliquely and extends from the edge of the second surface toward the middle of the second surface, an inclination angle of the first guide portion is same as the second guide portion, and an inclination direction of the first guide portion is same as the second guide portion, along the first direction, the first guide portion and the second guide portion are respectively located at opposite ends of the dumbbell piece, wherein the first direction is perpendicular to the axial direction of the mounting hole;
- two fixing plates, which are respectively sheathed on two ends of the grip rod, and the fixing plate is used for supporting the dumbbell rod and connecting the dumbbell pieces.

In one embodiment, the fixing plate includes an inner side surface and an outer side surface facing away from each other, the outer side surface is a side away from the middle of the grip rod, and the outer side is provided with the same structure as the first guide portion. The third guiding portion extends from the edge of the outer side surface toward the middle of the outer side surface.

In one embodiment, the outer side surface of the fixing plate and the first surface of the dumbbell piece are provided with a first engaging structure, the second surface of the dumbbell piece is provided with a second engaging structure, and the second engaging structure can cooperate with the first engaging structure on the fixing plate or the adjacent dumbbell piece, so that the fixing plate is axially connected with at least one of the dumbbell pieces.

In one embodiment, the first engaging structure is a slot extending along the first direction and forming a socket at one end;

- The second engaging structure is a socket plate, which is protruded from the surface of the dumbbell piece and extends along the first direction, and the socket plate can be inserted into the slot from the socket;
- at least one of the slot and the socket plate is provided with a clamp slot extending along the first direction, and the other is provided with a protrusion extending along the first direction, and the protrusion and the clamp slot are engaged with each other.

In one embodiment, the first guide portion extends from the edge of the first surface to the socket and is obliquely connected to the bottom surface of the slot, and the second guide portion is located at an end away from the socket; an inclination angle between the first guide portion and the bottom surface of the slot is 10°-30°.

In one embodiment, the grip rod includes an installation cavity, and the two telescopic rods are movably arranged in the installation cavity;

- the surface of the telescopic rod is provided with a spiral groove, and the grip rod is provided with a guide column extending radially, the guide column extends into the spiral groove, and the grip rod can drive the guide column to rotate and move in the spiral groove, so that the telescopic rod extends out or retracts into the installation cavity of the grip rod;
- the surface of the telescopic rod is provided with a flat section extending along its axial direction.

In one embodiment, the dumbbell further includes a rotating plate, the rotating plate is fixedly sleeved on the grip rod, and the rotating plate and the dumbbell piece are respectively connected to opposite sides of the fixing plate;

- one of the fixing plate and the rotating plate is provided with glass ball screws, and the other is provided with a plurality of ball holes distributed along the circumference, the grip rod can drive the rotating plate to rotate, and make the the balls of the glass ball screw snap into the ball holes.

In one embodiment, the dumbbell further includes a safety lock, the safety lock is arranged on the rotating plate and the fixing plate, and is used for locking the rotating plate and the fixing plate.

In one embodiment, the safety lock includes a safety buckle and a spring, the fixing plate is provided with a first limiting groove, and the rotating plate is provided with a second limiting groove communicated with the first limiting groove. groove;

- one end of the safety buckle is installed in the first limiting groove and can move in the first limiting groove along the radial direction of the fixing plate, and the other end is installed in the second limiting groove and can move in or out of the second limiting groove along the radial direction of the rotating plate;

the spring extends along the radial direction of the fixing plate and one end is abutted against the installation buckle, and the other end is abutted against the inner wall of the first limiting groove, and the safety buckle can be pressed along the fixing plate to move out of the second limiting groove.

In one embodiment, the safety buckle is exposed on the edge of the fixing plate, and the dumbbell base is provided with an unlocking projection opposite to the safety buckle, and the unlocking projection is used to press the safety buckle and the spring.

The dumbbell assembly provided by the present disclosure includes a dumbbell and a dumbbell base, and the dumbbell includes a dumbbell rod, dumbbell pieces and fixing plates. Because each dumbbell piece includes a first surface and a second surface facing away, the first guide portion is provided on the first surface, the first guide portion is arranged obliquely and extends from the edge of the first surface toward the middle of the first surface, and the second surface is provided with a second guide portion, the second guide portion is arranged obliquely and extends from the edge of the second surface toward the middle of the second surface, along the first direction, the first guide portion and the second guide portion are respectively arranged at the two ends of the dumbbell piece. Therefore, during the process of putting the dumbbell pieces into the dumbbell base, the first guide portion and the second guide portion on the adjacent dumbbell piece can guide and cooperate. In this way, on the one hand, the first guide portion and the second guide portion form an avoidance space, which can reduce interference, reduce the constraint standard when the dumbbell is lowered to the dumbbell base, improve the error tolerance rate during the lowering process, so that the dumbbell can be smoothly loaded into the dumbbell base when it has a certain inclination angle (caused by the user's grip angle); on the other hand, the first guide portion is used in conjunction with the second guide portion, and has a correction function, so that the lowering angle can be corrected synchronously during the dumbbell lowering process, so that the dumbbell can fall into the dumbbell base along the vertical direction. To sum up, the dumbbell assembly provided by the present disclosure, by improving the structure of the dumbbell pieces and designing the first guide portion and the second guide portion on the dumbbell pieces, can reduce the difficulty of installing the dumbbell rod into the dumbbell base, and solve the problem of adjusting the weight of the dumbbell, troublesome technical problems, improve the convenience and user experience of dumbbells.

BRIEF DESCRIPTION OF THE DRAWINGS

In order to more clearly illustrate the technical solutions in the embodiments of the present disclosure or the prior art, the following will briefly introduce the drawings that need to be used in the description of the embodiments or the prior art. Obviously, the accompanying drawings in the following description are only some embodiments of the present disclosure. Those skilled in the art can further obtain other drawings based on these drawings without creative work.

DETAILED DESCRIPTION OF THE EMBODIMENTS

Figure 1:
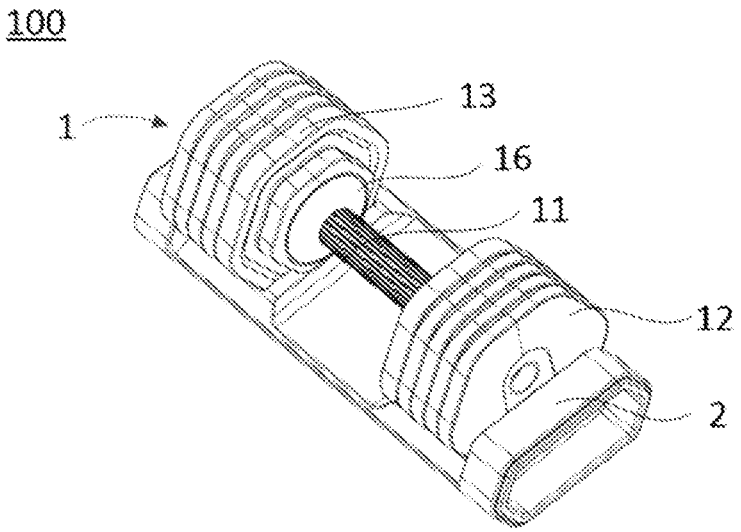
FIG. 1 is a schematic structural view of a dumbbell assembly provided in the embodiment of the present disclosure.

In order to make the purpose, technical solution and advantages of the present disclosure clearer, the present disclosure will be further described in detail below in conjunction with the accompanying drawings and embodiments. It should be understood that the specific embodiments described here are only used to explain the present disclosure, not to limit the present disclosure.

It should be noted that when a component is referred to as being "fixed on" or "disposed on" another component, it may be directly or indirectly on the other component. When an element is referred to as being "connected to" another element, it can be directly or indirectly connected to the other element. The orientation or positional relationship indicated by the terms "upper", "lower", "left", "right", etc. are based on the orientation or positional relationship shown in the drawings, and are for convenience of description only, rather than indicating or implying the referred device or elements must have a specific orientation, be constructed and operate in a specific orientation and therefore should not be construed as limiting the patent. The terms "first" and "second" are only used for descriptive purposes, and cannot be understood as indicating or implying relative importance or implicitly specifying the quantity of technical features. "plurality" means two or more, unless otherwise clearly and specifically defined.

Reference to "one embodiment," "some embodiments," or "an embodiment" in the specification of this disclosure means that a particular feature, structure, or characteristic described in connection with the embodiment is included in one or more embodiments of the disclosure. Thus, appearances of the phrases "in one embodiment," "in some embodiments," "in other embodiments," etc. in various places in this specification are not necessarily all refer to the same embodiment, but mean "one or more but not all embodiments" unless specifically stated otherwise. Furthermore, the particular features, structures or characteristics may be combined in any suitable manner in one or more embodiments.

Figure 2:
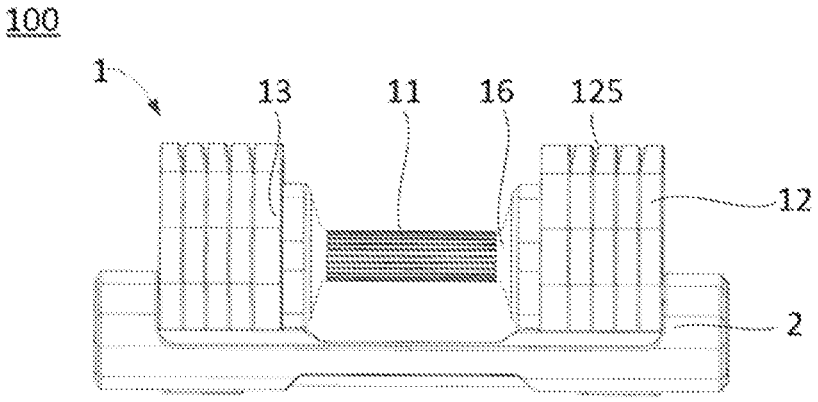
FIG. 2 is a front view of the dumbbell assembly shown in FIG. 1.

As shown in FIG. 1 and FIG. 2, the present disclosure provides a dumbbell assembly 100, including a dumbbell 1 and a dumbbell base 2 for placing the dumbbell 1, wherein the dumbbell 1 includes a dumbbell rod 11, dumbbell pieces 12 and two fixing plates 13, by adjusting the number of assembled dumbbell pieces 12 on the dumbbell rod 11 can realize the adjustment of the weight of the dumbbell 1.

Figure 3:
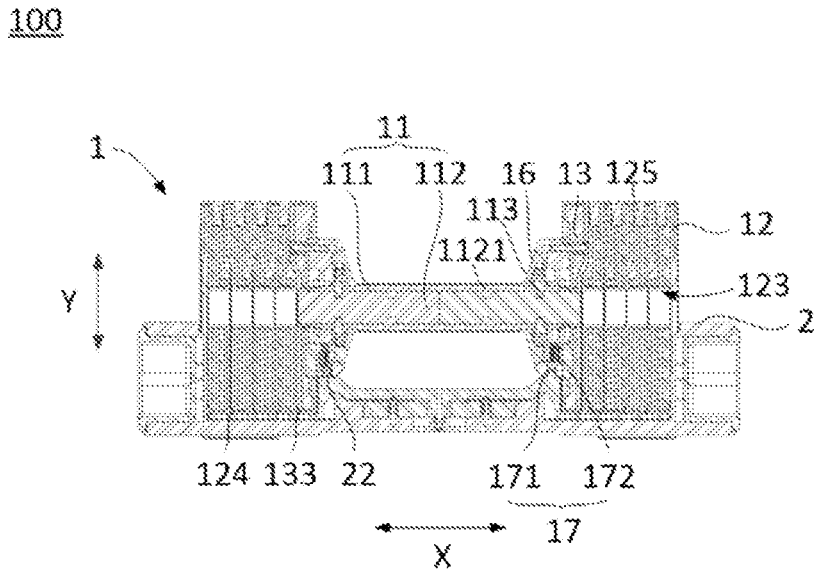
FIG. 3 is sectional view of the dumbbell assembly shown in FIG. 1.

As shown in FIG. 2 and FIG. 3, the dumbbell rod 11 includes a grip rod 111 and two telescopic rods 112 connected to the grip rod 111. The grip rod 111 and the telescopic rod 112 are arranged coaxially (e.g. FIG. 3, the direction shown by X in the middle) and moves away or towards each other. The telescopic rod 112 is used to install the dumbbell pieces 12, and the number of dumbbell pieces 12 that can be hung on is related to its length.

Figure 4:
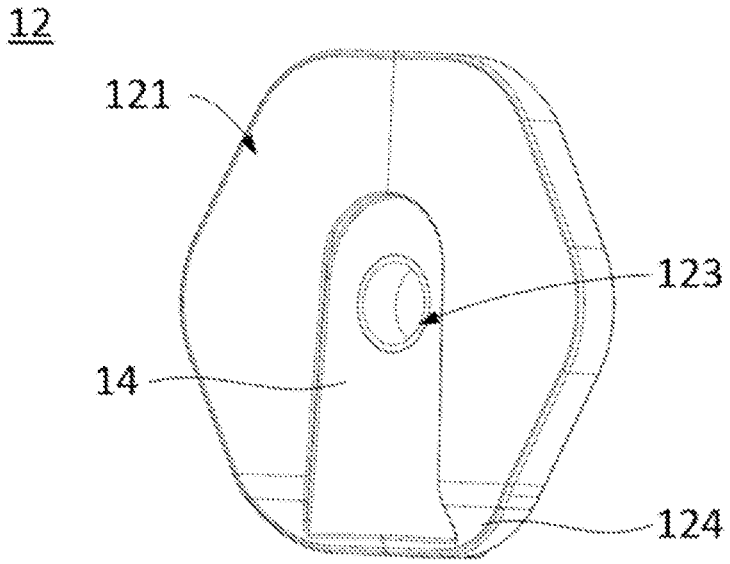
FIG. 4 is a structural schematic diagram of the first side surface of the dumbbell piece in the dumbbell assembly shown in FIG. 1.
Figure 5:
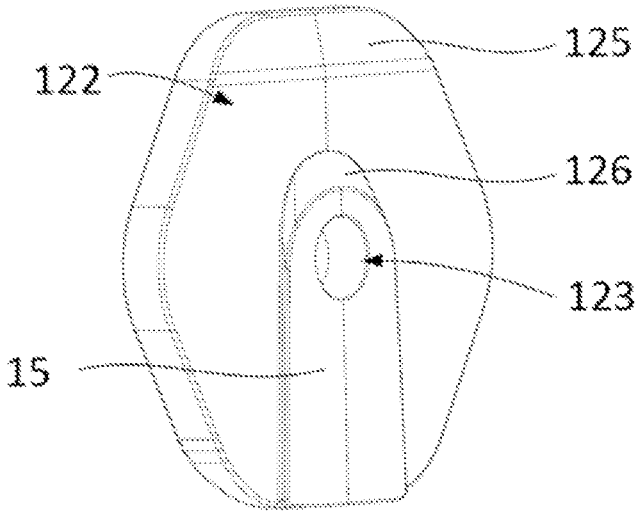
FIG. 5 is a structural schematic diagram of the second side surface of the dumbbell piece in the dumbbell assembly shown in FIG. 1.
Figure 6:
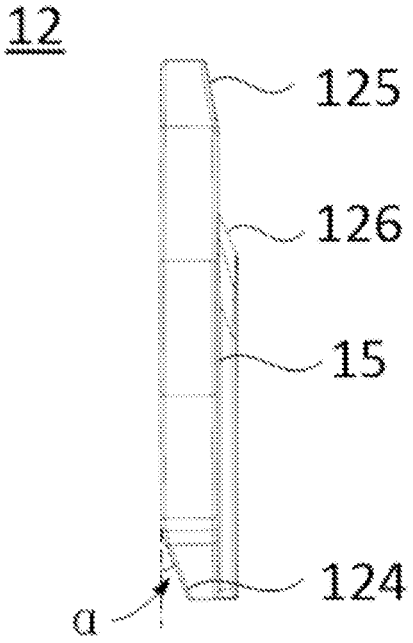
FIG. 6 is side view of a dumbbell piece in the dumbbell assembly shown in FIG. 1.

As shown in FIG. 3, FIG. 4 and FIG. 5, each dumbbell piece 12 includes a first surface 121 and a second surface 122 opposite to each other, and the dumbbell piece 12 is provided with a mounting hole 123 passing through the first surface 121 and the second surface 122 and allowing the telescopic rod 112 to pass through. As shown in FIG. 3 and FIG. 4, there is a first guide portion 124 on the first surface 121, the first guide portion 124 is arranged obliquely and extends from the edge of the first surface 121 toward the middle of the first surface 121. As shown in FIG. 3 and FIG. 5, there is a second guide portion 125 on the second surface 122, the second guide portion 125 is inclined and extends from the edge of the second surface 122 toward the middle of the second surface 122. As shown in FIG. 6, the inclination angle of the first guide portion is same as the second guide portion, and a inclination direction of the first guide portion 124 is same as the second guide portion 125, along the first direction (such as FIG. 3 The direction indicated by Y in the middle), the first guide portion 124 and the second guide portion 125 are respectively located at opposite ends of the dumbbell piece 12, and the first guide portion 124 and the second guide portion 125 can be used together. At the positions of the first guide portion 124 and the second guide portion 125, the thickness of the dumbbell pieces 12 decreases gradually. Wherein, the first direction is perpendicular to the axial direction of the mounting hole 123. As shown in FIG. 3, the dumbbell pieces 12 are stacked and placed in the dumbbell base 2, and the first surface 121 and the second surface 122 of the adjacent dumbbell pieces 12 are attached to each other. One of the first guide portion 124 and the second guide portion 125 is rotated to the top, and the other is rotated to the bottom, so that the first guide portion 124 and the second guide portion 125 on the adjacent dumbbell piece 12 can guide and cooperate.

Figure 7:
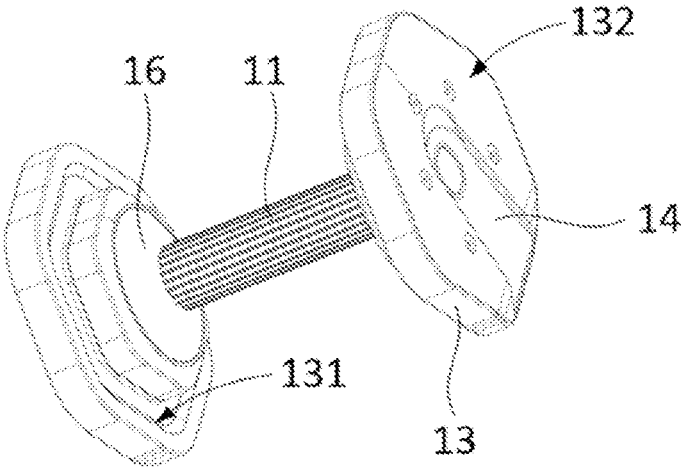
FIG. 7 is a schematic diagram of the structure of the dumbbell rod and the fixing plate in the dumbbell assembly shown in FIG. 1.

As shown in FIG. 2 and FIG. 7, the fixing plates 13 are sheathed on both ends of the grip rod 111 for supporting the dumbbell rod 11 and for connecting the dumbbell pieces 12. As shown in FIG. 3, the dumbbell rod 11, the dumbbell pieces 12 and the fixing plates 13 can be placed on the dumbbell base 2, and the fixing plates 13 are sleeved on the grip rod 111 of the dumbbell rod 11 to support the dumbbell rod 11, so that the dumbbell rod 11 is aligned with the mounting holes 123 of the dumbbell pieces 12.

Figure 8:
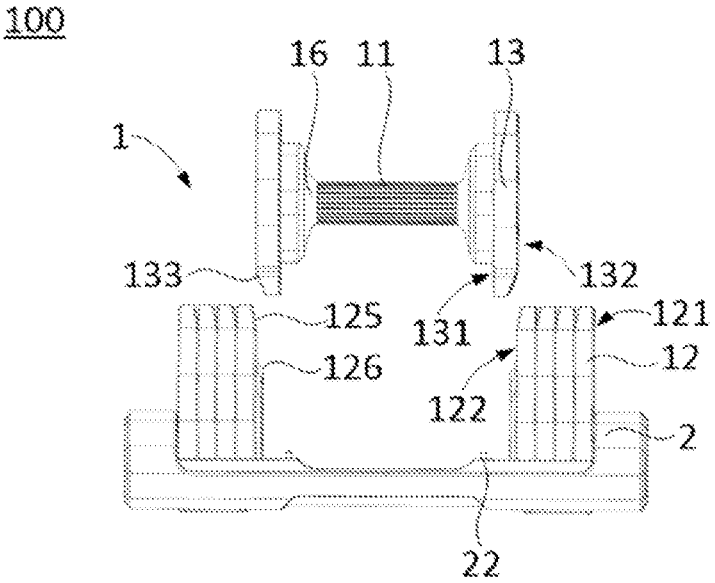
FIG. 8 is the first of the schematic diagrams for use of the dumbbell assembly shown in FIG. 1.
Figure 9:
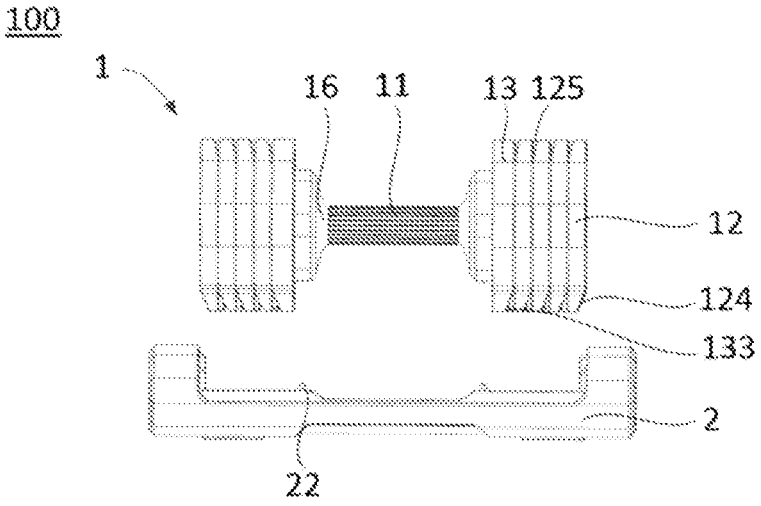
FIG. 9 is the second schematic diagram of the use of the dumbbell assembly shown in FIG. 1.
Figure 10:
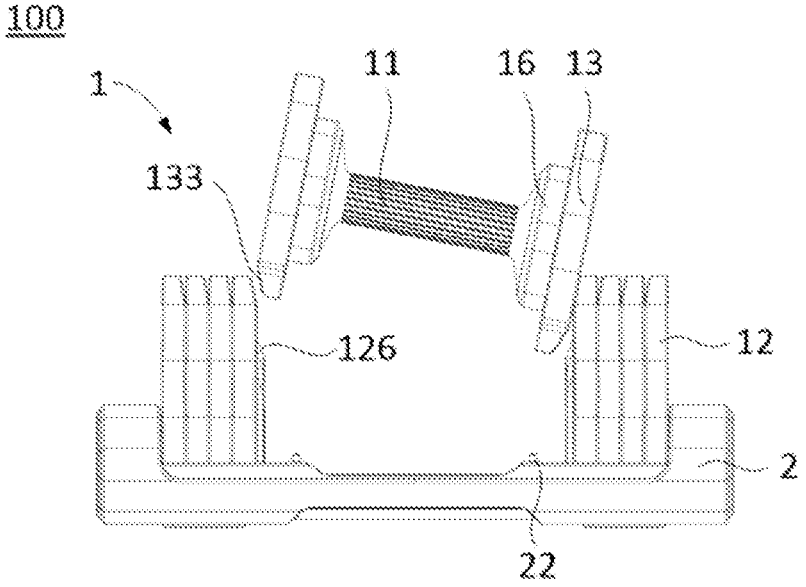
FIG. 10 is the third schematic diagram of the use of the dumbbell assembly shown in FIG. 1.

The specific usage of the above-mentioned dumbbell assembly 100 is as follows: firstly, the dumbbell 1 is placed on the dumbbell base 2, a plurality of dumbbell pieces 12 are stacked and placed in the accommodation groove 21 of the dumbbell base 2, and the telescopic movement of the dumbbell rod 11 The rod 112 is aligned with the mounting hole 123 of the dumbbell piece 12. When it is necessary to increase the counterweight, the grip rod 111 of the dumbbell 1 can be rotated so that the telescopic rod 112 extends to a preset length and the telescopic rod 112 penetrates into the mounting hole 123 of the dumbbell piece 12, thereby increasing the amount of hanging the dumbbell on the telescopic rod 112. The number of pieces 12 increases the counterweight of dumbbell 1; when the counterweight needs to be reduced, the grip rod 111 can be rotated in reverse to make the telescopic rod 112 retract to a preset length, so as to release the connection between the telescopic rod 112 and part of the dumbbell pieces 12, thereby reducing the number of dumbbell pieces 12 is hung on the telescopic rod 112 to reduce the weight of the dumbbell 1. As shown in FIG. 8, FIG. 9 and FIG. 10, the operator can complete the pick-and-place action of the dumbbell 1 by grasping the grip rod 111.

The dumbbell assembly 100 provided in this disclosure includes a dumbbell 1 and a dumbbell base 2, and the dumbbell 1 includes a dumbbell rod 11, a dumbbell piece 12 and a fixing plate 13. Since the dumbbell piece 12 includes opposite first surfaces 121 and second surfaces 122, the first surface 121 has a first guide portion 124, the first guide portion 124 is arranged obliquely and faces the first surface 121 from the edge of the first surface 121. Extending in the middle of the second surface 122, there is a second guide portion 125, the second guide portion 125 is inclined and extends from the edge of the second surface 122 toward the middle of the second surface 122, along the first direction, the first guide portion 124 and the second guide portion 125 are respectively arranged on the two ends of the dumbbell piece 12, so that when the dumbbell piece 12 is put into the dumbbell base 2, the first guide portion 124 and the second guide portion 125 on the adjacent dumbbell pieces 12 can guide and cooperate. In this way, on the one hand, the first guide portion 124 and the second guide portion 125 form an avoidance space, which can reduce interference, reduce the constraint standard when the dumbbell 1 is lowered to the dumbbell base 2, and improve the error tolerance rate during the lowering process, so that the dumbbell 1 can further be smoothly loaded into the dumbbell base 2 when it has a certain inclination angle (caused by the user's grip angle). The lowering angle can be corrected synchronously, so that the dumbbell 1 can be dropped into the dumbbell base 2 along the vertical direction. To sum up, the dumbbell assembly 100 provided by the present disclosure, by improving the structure of the dumbbell piece 12 and designing the first guide portion 124 and the second guide portion 125 on the dumbbell pieces 12, can reduce the difficulty in the installation of the dumbbell rod 11 into the dumbbell base 2, solve the technical problem of the troublesome operation of the dumbbell 1 to adjust the counterweight, and improve the convenience and user experience of the dumbbell 1.

As shown in FIG. 3 and FIG. 4, the mounting hole 123 is opened in the center of the dumbbell piece 12, and its shape is similar to the axial cross-section shape of the telescopic rod 112, so that the dumbbell 1 can be turned in any direction during use, and the weight of the dumbbell 1 is evenly distributed in all directions.

As shown in FIG. 3 and FIG. 7, the fixing plate 13 includes an inner side surface 131 and an outer side surface 132 opposite to each other, and the outer side surface 132 is a side away from the middle of the grip rod 111. Wherein, the middle of the grip rod 111 is the axial midpoint of the grip rod 111. As shown in FIG. 3 and FIG. 8, the dumbbell piece 12 is connected to the fixing plate 13, and the second surface 122 of the dumbbell piece 12 is attached to the outer side surface 132 of the fixing plate 13.

For further improving the smoothness of dumbbell rod 11 loading dumbbell base 2 actions, as shown in FIG. 3, FIG. 8 and FIG. 9, the outer side surface 132 of the fixing plate 13 is provided with a third guide portion 133 having the same structure as the first guide portion 124, and the third guide portion 133 extends from the edge of the outer side surface 132 toward the middle of the outer side surface 132. Set up in this way, in the process of loading the dumbbell base 2 with the dumbbell rod 11 that is not hung with the dumbbell piece 12, as shown in FIG. 3, FIG. 8 and FIG. 10, the third guide portion 133 on the fixing plate 13 can guide and cooperate with the second guide portion 125 of the dumbbell piece 12 provided on the dumbbell base 2, thereby reducing the difficulty of installing the unloaded dumbbell rod 11 and further improving the stability of the dumbbell 1.

In the dumbbell assembly 100 provided in this disclosure, the dumbbell piece 12 is hung on the telescopic rod 112 of the dumbbell rod 11, and the fixed connection between the dumbbell piece 12 and the dumbbell rod 11 is not unique.

In some embodiments, as shown in FIG. 3, FIG. 4 and FIG. 7, the outer side surface 132 of the fixing plate 13 and the first surface 121 of the dumbbell piece 12 are provided with a first engaging structure 14. As shown in FIG. 3, FIG. 5 and FIG. 7, the second surface 122 of the dumbbell piece 12 is provided with a second engaging structure 15, and the second engaging structure 15 can be engaged with the fixing plate 13 or the first engaging structure 14 on the adjacent dumbbell piece 12, so that the fixing plate 13 is axially connected with at least one dumbbell piece 12. In this way, the dumbbell pieces 12 and the fixing plates 13, as well as between the adjacent dumbbell pieces 12, can be snapped together through the engaging structure, and the axial fixed connection can be realized, so that the telescopic rod 112 can be inserted into the mounting hole 123 of the dumbbell pieces 12. After that, the axial and radial fixation of the dumbbell pieces 12 can be realized, and the fixed connection between the dumbbell pieces 12 and the dumbbell rod 11 can be realized. The connection structure between the dumbbell pieces 12 and the dumbbell rod 11 is reasonable and easy to assemble and disassemble.

Or, in some embodiments, a matching threaded structure can further be provided on the wall of the telescopic rod 112 and the mounting hole 123 of the dumbbell piece 12, and the dumbbell pieces 12 and the telescopic rod 112 can be axially fixed by threaded connection, so as to realize the dumbbell piece 12 is fixedly connected with dumbbell rod 11.

When the engaging structure is used to connect the fixing plate 13 and the dumbbell pieces 12, the type of the engaging structure is not unique.

In some embodiments, as shown in FIG. 4, the first engaging structure 14 is a slot extending along a first direction and forming a socket at one end. As shown in FIG. 5, the second engaging structure 15 is a socket plate, which protrudes from the surface of the dumbbell piece 12 and extends along the first direction, and the socket plate can be plugged into the slot from the socket. At least one of the slot and the socket plate is provided with a slot extending along the first direction, and the other is provided with a protrusion extending along the first direction, and the protrusion is engaged with the slot. Such arrangement, on the one hand, the slot and the socket plate are simple in structure, and the fixing plate 13 and the dumbbell piece 12 are easy to disassemble; on the other hand, when the dumbbell 1 is placed on the dumbbell base 2, the first surface 121 of the outermost dumbbell piece 12 The first surface 121 of the dumbbell piece 12 is provided with slots, and the structure is reasonable.

Optionally, two opposite groove walls of the slot are provided with card slots, the socket plate protrudes from the surface of the dumbbell piece 12, and the two opposite sides of the socket plate form card protrusions.

Further, as shown in FIG. 4, the slot is a dovetail slot and the width of the socket along the second direction is greater than the width of the end of the slot away from the socket. Wherein, the second direction is perpendicular to the first direction and the axial direction of the mounting hole 123. Such setting can reduce the difficulty of aligning the slot and the plug board, thereby reducing the difficulty of assembling the slot and the plug board, and further improving the convenience of use of the dumbbell assembly 100.

Further, the cross-sectional shape of the slot can be square, V-shaped or U-shaped, etc.

Or, in some embodiments, the first engaging structure 14 and the second engaging structure 15 can further be designed as a plug board, and the third engaging structure can be designed as a slot adapted to the plug board, and The specific structure of the groove and the plug plate, and the placement of the dumbbell piece 12 during use are designed according to actual conditions, and are not limited here.

It should be noted that the first direction is used to illustrate the relative positions of the first guide portion 124 and the second guide portion 125, as well as the structure of the slot and the plug board, and any direction on the surface of the fixing plate 13 or the dumbbell piece 12 can be selected. The direction is as the first direction. In actual use, in order to ensure that the dumbbell 1 can be used normally, it is necessary to adjust the installation angle of the dumbbell piece 12 and the dumbbell rod 11 so that the defined first direction and the vertical direction (such as FIG. 3 in the direction indicated by Y) and keep the notch of the socket turned to the bottom. And, in actual use, since the dumbbell piece 12 is placed vertically, the axial direction of the mounting hole 123 is consistent with the axial direction of the grip rod 111 and the telescopic rod 112, so no distinction is made here.

In an embodiment provided by this disclosure, as shown in FIG. 3 and FIG. 4, the first engaging structure 14 is a slot, and the slot includes a socket. The first guide portion 124 extends from the edge of the first surface 121 to the socket and is obliquely connected to the bottom surface of the slot. The second guide portion 125 is located away from the socket.

Similarly, the third guiding portion 133 extends from the edge of the outer side surface 132 to the socket of the corresponding slot, and is obliquely connected to the bottom surface of the corresponding slot.

Further, the angle between the first guide portion 124 and the bottom surface of the slot is 10°-30° (The angle $\alpha$ shown in FIG. 6). Optionally, in an embodiment, the angle between the first guide portion 124 and the bottom surface of the slot is 22.5°. With such arrangement, the structure of the first guiding part 124 and the second guiding part 125 is reasonable, and the guiding effect is good.

In an embodiment provided by this disclosure, as shown in FIG. 8 and FIG. 10, the end of the plug board away from the socket has a fourth guide portion 126, and the inclination direction of the fourth guide portion 126 is consistent with that of the second guide portion 125. The fourth guide portion 126 can be in contact with the first surface 121 of the adjacent dumbbell piece 12 and has a certain guiding effect, which is beneficial to further improving the smoothness of the dumbbell rod 11 being put into the dumbbell base 2.

In the dumbbell assembly 100 provided in the present disclosure, the connection mode between the telescopic rod 112 and the grip rod 111 is not unique.

Figure 12:
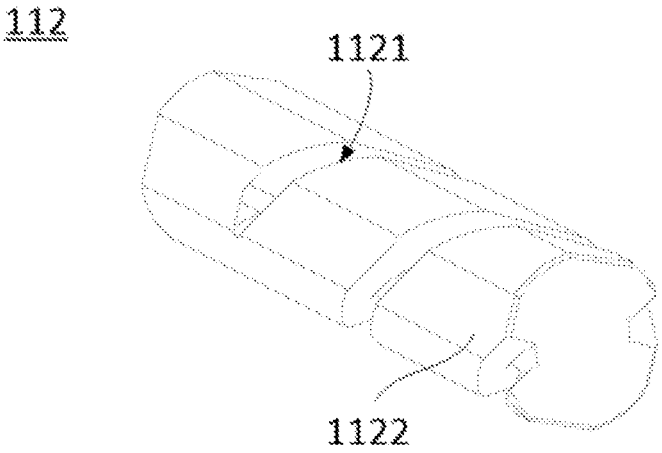
FIG. 12 is a schematic diagram of the structure of the telescopic rod in the dumbbell assembly shown in FIG. 1.

In some embodiments, as shown in FIG. 3 and FIG. 12, the grip rod 111 includes an installation cavity, and two telescopic rods 112 are arranged in the installation cavity.

The surface of the telescopic rod 112 is provided with a spiral groove 1121, and the grip rod 111 is provided with a guide column 113 extending radially thereon. The column 113 moves in the spiral groove 1121, thereby converting the rotation of the grip rod 111 into the linear movement of the telescopic rod 112, so that the telescopic rod 112 extends out or retracts into the installation cavity of the grip rod 111. With such arrangement, the structure of the grip rod 111 and the telescopic rod 112 is simple, and the telescopic rod 112 is easy to adjust.

It can be understood that the number of dumbbell pieces 12 that can be assembled with the telescopic rod 112 is related to the length that extends out of the installation cavity of the grip rod 111.

Further, in order to improve the convenience of use, the grip rod 111 is provided with anti-slip threads.

Further, as shown in FIG. 12, the surface of the telescopic rod 112 is provided with a flat section 1122 extending along its axial direction to ensure that the telescopic rod 112 can move in a straight line.

It can be understood that, in some embodiments, the axial section of the telescopic rod 112 is circular, and the inner side surface of the grip rod 111 and the outer side surface of the telescopic rod 112 are provided with a matching thread structure, and are threaded through the thread structure to rotate the grip rod 111, which can drive the telescopic rod 112 to rotate and move linearly along the grip rod 111.

When adjusting the counterweight of the dumbbell 1, it is necessary to adjust the extension length of the telescopic rod 112 by rotating the grip rod 111, wherein the movement size of the telescopic rod 112 is related to the rotation angle of the grip rod 111, and the design of the actual movement size of the telescopic rod 112 should be based on the dumbbell piece 12 to be disassembled.

In order to conveniently control the rotation angle of the grip rod 111 and the moving size of the telescopic rod 112, the dumbbell assembly 100 provided by the present disclosure, as shown in FIG. 3 and FIG. 8, the dumbbell 1 further includes a rotating plate 16, the rotating plate 16 is fixedly sleeved on the grip rod 111, the rotating plate 16 and the dumbbell piece 12 are respectively connected to the opposite sides of the fixing plate 13, specifically, the rotating plate 16 is connected to the inner side surface 131 of the fixing plate 13. One of the fixing plate 13 and the rotating plate 16 is provided with glass ball screws, and the other is provided with a plurality of ball holes distributed along the circumference. The grip rod 111 can drive the rotating plate 16 to rotate, and the balls of the glass ball screws can be clamped into the ball hole. The glass ball screw and the ball hole can be regarded as a gear adjuster. The balls of the glass ball screw slide into different ball holes, which can reflect different gear positions and correspond to the weight of the dumbbell 1. When the ball of the glass ball screw slides into the ball hole, it can make a sound, and the user can control the rotation of the grip rod 111 according to the sound instruction.

Optionally, glass ball screws are provided on the side of the fixing plate 13 connected to the rotating plate 16, and ball holes are provided on the side of the rotating plate 16 connected to the fixing plate 13.

It should be noted that the ball holes are distributed on the rotation track of the rotating plate 16, and the specific distribution needs to be designed according to the dumbbell pieces 12. If a plurality of dumbbell pieces 12 have the same weight and the same thickness, then a plurality of ball holes are evenly distributed along the circumference. If a plurality of dumbbell pieces 12 have the different weight and the different thickness, then the distance of different ball holes is different, and the distance is proportional to the thickness of the dumbbell pieces 12.

In addition, the fixing plate 13 can be sleeved on the grip rod 111 through a ring or the like, and the grip rod 111 can rotate relative to the ring, and the fixing plate 13 does not rotate with the grip rod 111 during the rotation process. The connection mode between the fixing plate 13 and the grip rod 111 can be designed according to the actual situation, which is not limited here.

As shown in FIG. 3, the grip rod 111 is sleeved with a rotating plate 16 and a fixing plate 13, and the grip rod 111 is provided with a through hole. One end of the guide column 113 is fixedly connected to the rotating plate 16, and the other end passes through the through hole and is inserted into the accommodating cavity of the grip rod 111, rotating the grip rod 111 can drive the guide column 113 and the rotating plate 16 to rotate together.

Further, the surface of the rotating plate 16 is marked with counterweight data.

The dumbbell assembly 100 provided by the disclosure, as shown in FIG. 3, the dumbbell 1 further includes a safety lock 17, which is arranged on the rotating plate 16 and the fixing plate 13 for locking the rotating plate 16 and the fixing plate 13. Before adjusting the weight of dumbbell 1, it needs to be unlocked first. By adopting the above design, the use safety of the dumbbell 1 can be improved.

Further, as shown in FIG. 3, the safety lock 17 includes a safety buckle 171 and a spring 172, the fixing plate 13 is provided with a first limiting groove, and the rotating plate 16 is provided with a second limiting groove communicating with the first limiting groove. One end of the safety buckle 171 is installed in the first limiting groove and can move in the first limiting groove along the radial direction of the fixing plate 13, and the other end is installed in the second limiting groove and can move in along the radial direction of the rotating plate 16. Or move out of the second limiting groove. The spring 172 extends radially along the fixing plate 13 and one end is against the mounting buckle, and the other end is against the inner wall of the first limiting groove. The safety buckle 171 is pressed and can move along the radial direction of the fixing plate 13 to move out of the second limit slot. Adopt above-mentioned design, safety lock 17 is reasonable in structure, easy to use.

The safety buckle 171 is provided with a accommodation groove, and the spring 172 is partly installed in the accommodation groove.

Figure 11:
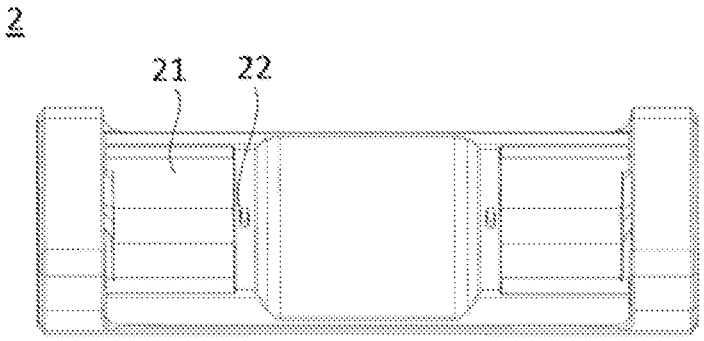
FIG. 11 is a schematic diagram of the structure of the dumbbell base in the dumbbell assembly shown in FIG. 1.

As shown in FIG. 3, FIG. 10 and FIG. 11, the safety buckle 171 is exposed on the edge of the fixing plate 13, and the dumbbell base 2 is provided with an unlocking projection 22 opposite to the safety buckle 171, and the unlocking projection 22 is used to press the safety buckle 171 and the spring 172. As shown in FIG. 11, the unlocking projection 22 is located at the bottom of the accommodation groove 21. With the above design, when the dumbbell 1 is placed on the dumbbell base 2, it can be automatically unlocked and the operation is simple.

The dumbbell assembly 100 includes a plurality of dumbbell pieces 12 with similar shapes so that the multiple dumbbell pieces 12 can be assembled together. The weights of the multiple dumbbell pieces 12 can be the same or different.

In an embodiment provided by the present disclosure, the weight of the dumbbell rod 11, the fixing plate 13 and the rotating plate 16 is 51b, and the dumbbell 1 includes 8 replaceable dumbbell pieces 12, and the 8 pieces of dumbbell pieces 12 have the same structure and the weight of each piece is 2.5 lb, the dumbbell 1 can adjust the weight range from 2.5 to 25 lb.

To sum up, the dumbbell assembly 100 provided by the present disclosure, by improving the structure of the dumbbell piece 12 and designing the first guide portion 124 and the second guide portion 125 on the dumbbell piece 12, can reduce difficulty of the installation of the dumbbell rod 11 into the dumbbell base 2, solve the technical problem of the troublesome operation of the dumbbell 1 to adjust the counterweight, and improve the convenience and user experience of the dumbbell 1.

The above embodiments are only used to illustrate the technical solutions of the present disclosure, rather than to limit them; although the present disclosure has been described in detail with reference to the foregoing embodiments, those of ordinary skill in the art should understand that: it can still apply to the foregoing embodiments. Modifications to the technical solutions recorded, or equivalent replacements for some of the technical features; and these modifications or replacements do not make the essence of the corresponding technical solutions deviate from the spirit and scope of the technical solutions of each embodiment of the disclosure, and should be included in the scope of protection of this disclosure.

What is claimed is:

1. A dumbbell assembly, comprising:

a dumbbell and a dumbbell base for placing the dumbbell, and the dumbbell comprises:

a dumbbell rod, wherein the dumbbell comprises a grip rod and two telescopic rods connected to the grip rod, the grip rod and the two telescopic rods are coaxially arranged, and a rotation of the grip rod can drive the two telescopic rods to move along an axial direction of the grip rod away or towards each other;

a plurality of dumbbell pieces, wherein each dumbbell piece comprises a first surface and a second surface opposite to each other, and each dumbbell piece is provided with a mounting hole passing through the first surface and the second surface and allowing the telescopic rod to pass through, the first surface is provided with a first guide portion, the first guide portion is inclined and extends from an edge of the first surface toward a middle of the first surface, and the second surface is provided with a second guide portion, the second guide portion is inclined and extends from an edge of the second surface toward an middle of the second surface, an inclination angle of the first guide portion is same as the second guide portion, and an inclination direction of the first guide portion is same as the second guide portion, along a first direction, the first guide portion and the second guide portion are respectively located at opposite ends of each dumbbell piece, wherein the first direction is perpendicular to an axial direction of the mounting hole;

two fixing plates, wherein the two fixing plates are respectively sheathed on two ends of the grip rod, and the two fixing plates are used for supporting the dumbbell rod and connecting the dumbbell pieces.

2. The dumbbell assembly according to claim 1, wherein each fixing plate comprises an inner side surface and an outer side surface which are opposite to each other, the outer side surface is away from a middle of the grip rod, and the outer side surface is provided with a third guide portion having a same structure as the first guide portion, the third guiding portion extends from an edge of the outer side surface toward a middle of the outer side surface.

3. The dumbbell assembly according to claim 2, wherein the outer side surface of each fixing plate and the first surface of the dumbbell piece are provided with a first engaging structure, and the second surface of the dumbbell piece is provided with a second engaging structure, and the second engaging structure can cooperate and engage with the fixing plate or the first engaging structure on an adjacent dumbbell piece, so that the fixing plate is axially connected with at least one of the dumbbell pieces.

4. The dumbbell assembly according to claim 3, wherein the first engaging structure is a slot extending along the first direction and forming a socket at one end;

the second engaging structure is a socket plate, which is protruded from the second surface of each dumbbell piece and extends along the first direction, and the socket plate can be inserted into the slot from the socket;

at least one of the slot and the socket plate is provided with a clamp slot extending along the first direction, and the other is provided with a protrusion extending along the first direction, and the protrusion and the clamp slot are engaged with each other.

5. The dumbbell assembly according to claim 4, wherein the first guide portion extends from the edge of the first surface to the socket and is obliquely connected to a bottom surface of the slot, and the second guide portion is located at an end away from the socket;

an inclination angle between the first guide portion and the bottom surface of the slot is 10°-30°.

6. The dumbbell assembly according to claim 1, wherein the grip rod comprises an installation cavity, and the two telescopic rods are movably arranged in the installation cavity;

a surface of the telescopic rod is provided with a spiral groove, and the grip rod is provided with a guide column extending radially, the guide column extends into the spiral groove, and the grip rod can drive the guide column to rotate and move in the spiral groove, so that the telescopic rod extends out or retracts into the installation cavity of the grip rod;

the surface of the telescopic rod is provided with a flat section extending along its axial direction.

* * * * *